US006208310B1

(12) United States Patent
Suleiman et al.

(10) Patent No.: US 6,208,310 B1
(45) Date of Patent: Mar. 27, 2001

(54) MULTIMODE CHOKED ANTENNA FEED HORN

(75) Inventors: Shady H. Suleiman, Wilmington; Charles W. Chandler, San Gabriel, both of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/351,896

(22) Filed: Jul. 13, 1999

(51) Int. Cl.[7] ..... H01Q 13/00
(52) U.S. Cl. ..... 343/786; 343/772; 343/783
(58) Field of Search ..... 343/786, 772, 343/183; H01Q 13/00

(56) References Cited

U.S. PATENT DOCUMENTS

| | | | | |
|---|---|---|---|---|
| 4,658,258 | * | 4/1987 | Wilson | 343/786 |
| 4,731,616 | * | 3/1988 | Fulton et al. | 343/786 |
| 4,792,814 | * | 12/1988 | Ebisui | 343/786 |
| 5,486,839 | * | 1/1996 | Rodeffer et al. | 343/786 |

OTHER PUBLICATIONS

Thomas A. Milligan, "Modern Antenna Design," McGraw–Hill Book Company, pp. 200–205.

P. D. Potter, "A New Horn Antenna With Suppressed Sidelobes And Equal Beamwidths," Microwave J., vol. VI, pp. 71–78, Jun. 1963.

* cited by examiner

*Primary Examiner*—Don Wong
*Assistant Examiner*—Hoang Nguyen
(74) *Attorney, Agent, or Firm*—Michael S. Yatsko

(57) ABSTRACT

An antenna feed horn (10) for a satellite antenna array that includes multiple chokes (34, 36, 40, 42, 44) that provide effective control of the horn aperture mode content to generate radiation patterns which substantially have equal E-plane and H-plane beamwidths, low cross-polarization, low axial ratio, and suppressed sidelobes. The chokes (34, 36, 40, 42, 44) are annular notches that have both radial and axial dimensions. Two chokes (34, 36) are provided at an internal transition location between a conical profile section (14) and a cylindrical aperture section (16). Additionally, another choke (44) is provided in the aperture (20) of the horn (10), and two additional chokes (40, 42) are provided proximate the aperture (20). The size and location of the chokes (34, 36, 40, 42, 44) are optimized for the desirable mode content at the frequency band of interest to allow the propagation modes to be properly phase oriented relative to each other so that the useful bandwidth of the signal is on the order of 10% or greater.

21 Claims, 2 Drawing Sheets

MULTIMODE CHOKED ANTENNA FEED HORN

BACKGROUND OF THE INVENTION

1. Field of the Invention

This invention relates generally to an antenna feed horn, and more particularly, to a compact, low weight, relatively easy to manufacture, and cost effective antenna feed horn for a satellite communications antenna array, that includes multiple chokes to provide radiation patterns with substantially equal E- and H-plane beamwidths, suppressed sidelobes, low cross-polarization, and low axial ratio across a relatively wide bandwidth or over multiple widely-separated frequency bands. Additional important features of the horn are the wide-frequency impedance match and the relatively fixed phase center from the horn aperture over a wide bandwidth.

2. Discussion of the Related Art

Various communication networks, such as Ka-band satellite communications networks, employ satellites orbiting the Earth in a geosynchronous orbit. A satellite uplink communications signal is transmitted to the satellite from one or more ground stations, and then is switched and retransmitted by the satellite to the Earth as a downlink communications signal to cover a desirable reception area. The uplink and downlink signals are transmitted at a particular frequency bandwidth and are coded. Both commercial and military Ka-band communication satellite networks require a high effective isotropic radiated power (EIRP) in the downlink signal, and an acceptable gain versus temperature ratio (G/T) in the uplink signal for the communications link. The EIRP and acceptable G/T require a high gain antenna system providing a smaller beam size, thus reducing the beam coverage and requiring a multi-beam antenna system. The satellite is therefore equipped with an antenna system that includes a plurality of antenna feed horns arranged in a predetermined configuration that receive the uplink signals and transmit the downlink signals to the Earth over a predetermined field-of-view.

The antenna system must provide a beam scan capability up to fifteen beamwidths away from the antenna boresight with a low scan loss and minimal beam distortion in order to compensate for the longer path length losses at the edges of the field-of-view. Multi-beam antenna systems that produce a system of contiguous beams by the plurality of feed horns require highly circular beam symmetry, steep main beam roll-off, suppressed sidelobes and low cross-polarization to achieve low interference between adjacent beams. To provide maximum signal strength intensity independent of the user's orientation, it is necessary that the communications signals be circularly polarized.

To accomplish the above-stated parameters, the antenna feed horns must be capable of producing beam radiation patterns that have substantially equal E-plane and H-plane beamwidths over the operating frequency band of the signal. The level of the cross-polarization and the ratio of the E-plane beamwidth to the H-plane beamwidth in the downlink or uplink signal determines the axial ratio of the signal. If the cross-polarization is substantially negligible and the E-plane and H-plane beamwidths are substantially the same, the axial ratio is about one and the signals are effectively circularly polarized. However, if the E-plane and H-plane beamwidths are significantly different, the signal is elliptically polarized and the received signal strength is reduced, causing increased insertion loss and data rate loss of the uplink or downlink signal.

The useable bandwidth of the downlink signal that is able to transmit information is determined by the combination of the various propagation modes (amplitude and phase) over frequency in the horn aperture. These feed horn propagation modes include the transverse electric ($TE_{mn}$) modes and the transverse magnetic ($TM_{mn}$).

Traditional, conical shaped feed horns for satellite antenna systems typically limited to a single ($TE_{11}$) mode content of the communication signal (uplink and downlink) and had a high axial ratio, and where the E-plane beamwidth was substantially different than the H-plane beamwidth. In order to correct the axial ratio and provide a more circularly polarized beam, Potter feed horns and corrugated feed horns were developed in the art that generated substantially equal E-plane and H-plane patterns with suppressed sidelobes. The Potter horn is disclosed in Potter, P. D., "A New Horn Antenna with Suppressed Sidelobes and Equal Beamwidths," Microwave, J., Vol. XI, June 1963, pp. 71–78. The Potter Horn is a conical-shaped feed horn that includes a single step transition that generates an additional ($TM_{11}$) mode for equal E-plane and H-plane beamwidths and suppressed sidelobes. A corrugated horn is a conical shaped feed horn that includes a corrugated structure within the horn from the input port to the aperture that also allows propagation of the $TM_{11}$, mode and suppresses the sidelobes.

Although the configuration of the Potter horn is generally successful in providing a desirable mode content with low cross-polarization and suppressed sidelobe levels, the Potter horn generates signals that are limited by their useful bandwidth, on the order of 3%, because of the amplitude and phase relationship of the propagating modes at the horn aperture. The corrugated horn is able to provide wider bandwidth at the higher mode content, but does so at the expense of signal loss. Additionally, the corrugated horn includes significant horn material, and thus is not lightweight and cost effective suitable for the space environment.

What is needed is a compact, lightweight, easy to manufacture, and cost effective antenna feed horn that provides substantially equal E-plane and H-plane beamwidths, low cross-polarization and suppressed sidelobes, but has a higher useful bandwidth than those feed horns known in the art. It is therefore the objective of the present invention to provide such an antenna feed horn.

SUMMARY OF THE INVENTION

In accordance with the teachings of the present invention, an antenna feed horn for a satellite antenna array is disclosed that includes multiple chokes to provide an effective control of the mode content in the horn aperture to generate radiation patterns with substantially equal E-plane and H-plane beamwidths, low cross-polarization, and suppressed sidelobes. The chokes are annular notches that have both radial and axial dimensions. In one particular embodiment, two chokes are provided at an internal transition location between a conical profile section and a cylindrical aperture section. Additionally, another choke is provided at the aperture of the horn, and two additional chokes are provided proximate the aperture. The size and location of the chokes is optimized for the desirable mode content at the frequency band of interest to allow the propagation modes to be properly phased relative to each other so that the useful bandwidth of the signal is on the order of 10% or greater.

Additional objectives, advantages and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a multi-mode choked antenna feed horn for a satellite antenna array is merely exemplary in nature, and is in no way intended to limit the invention or its applications or uses.

Figure 1:
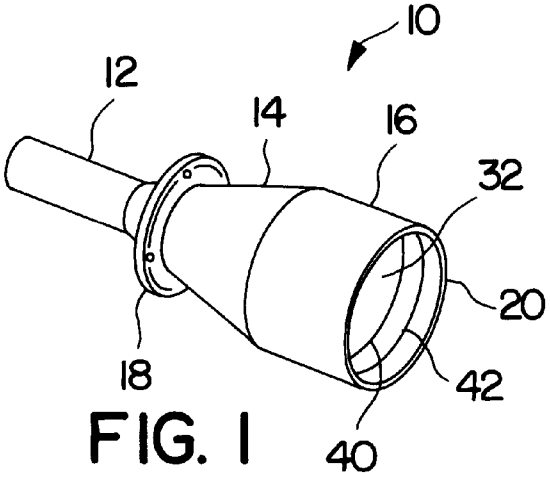
FIG. 1 is a perspective view of an antenna feed horn including multiple chokes, according to an embodiment of the present invention.
Figure 2:
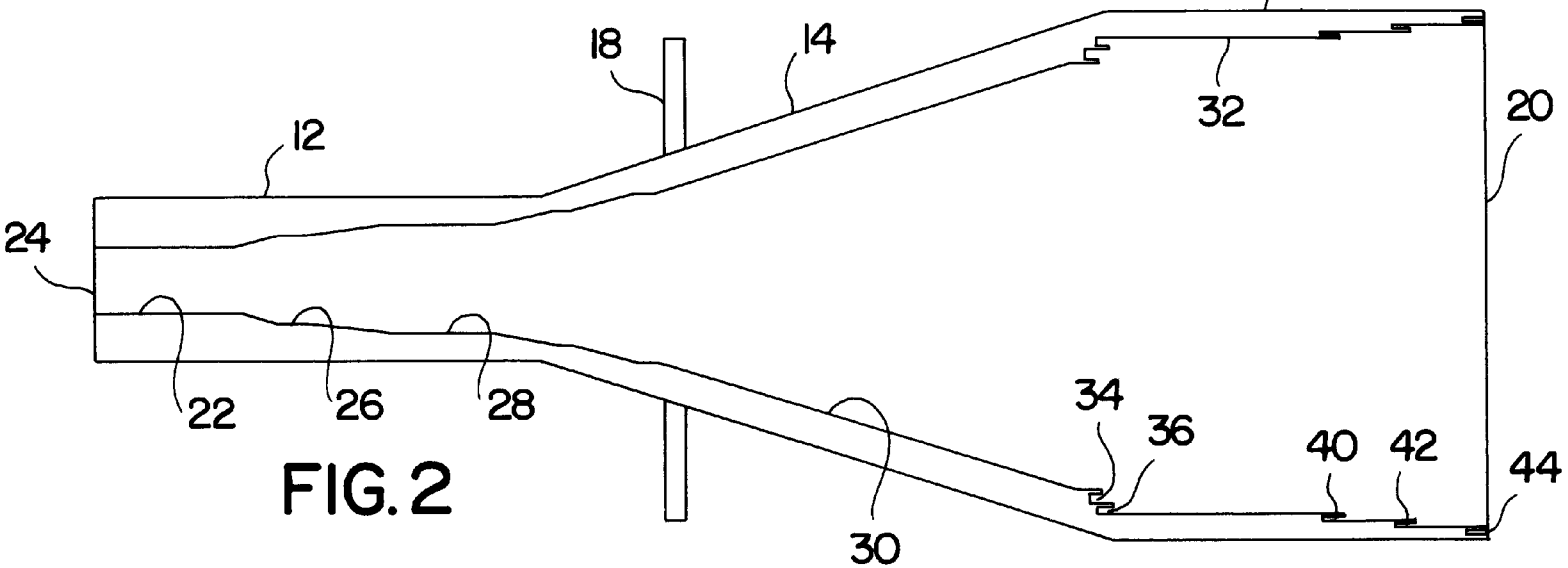
FIG. 2 is a side plan view of the antenna feed horn shown in FIG. 1.

FIG. 1 is a perspective view and FIG. 2 is a side plan view of an antenna feed horn 10, according to the invention. The feed horn 10 would be one of a plurality of antenna feed horns associated with an antenna array used in connection with a satellite communications network that is operating, for example, in the Ka frequency band. The antenna system can take on any suitable configuration and optical geometry for this type of communications network, such as a side-fed antenna system, a front-fed antenna system, a cassegrain antenna system, and a Gregorian antenna system. However, as will be appreciated by those skilled in the art, the design of the feed horn 10 is not limited to a particular communications network or antenna system, but has a wider application for many types of communications systems and networks. Additionally, the discussion of the feed horn 10 below will be directed to using the feed horn for the downlink signal of the satellite communications network. However, the feed horn 10 also has reception capabilities for receiving a signal transmitted from the Earth to the satellite on a satellite uplink. Also, the feed horn 10 will transmit a signal having a frequency consistent with the communications network, such as the Ka frequency bandwidth, but can be used for any applicable frequency bandwidth, both commercial and military, including the Ku-band.

The antenna feed horn 10 includes a throat section 12, a profile section 14 and an aperture section 16 connected together to form a single unit. An input end of the throat section 12 would be connected to a signal waveguide (not shown), which would be connected to a beam generating system (not shown), as would be well understood to those skilled in the art. The signal travels from the waveguide through the throat section 12 and expands through the profile section 14. The expanded signal then exits the feed horn 10 at an aperture mouth 20 opposite to the throat section 12. An annular mounting flange 18 encircles the profile section 14 and provides a mechanism for mounting the horn 10 to an antenna support structure (not shown). As will be discussed below, the configuration of the inside of the horn 10 provides propagation of desirable incident TE and TM modes at the horn aperture while suppressing undesirable interfering sidelobes, and generates substantially equal E-plane and H-plane beamwidths with low cross-polarization and low phase center variation across a relatively wide bandwidth.

The outer surface of the throat section 12 is cylindrical, and an internal surface of the throat section 12 includes a cylindrical throat portion 22 proximate an input end 24 of the horn 10. The signal traveling through the cylindrical portion 22 expands in a first expanding throat transition portion 26 connected to the cylindrical portion 22 and a second expanding throat transition portion 28 connected to the transition portion 26, as shown. The first and second expanding portions 26 and 28 gradually widen the opening of the feed horn 10 from the input end 24, so that the combination of the throat portions 22, 26 and 28 act to lower the cross-polarization of the frequency signal to lessen interference between adjacent beams generated by the antenna system. The expanding portions 26 and 28 are specially designed to be different and have the shape as shown to provide this function. The expanding portion 28 continues to expand into the profile section 14. The profile section 14 has an outer conical surface and an inner profile surface 30 defined by a sine-squared function. The advantage of choosing a profile geometry is in providing a horn that is compact in size, shorter in length and thus lower in weight.

Figure 3:
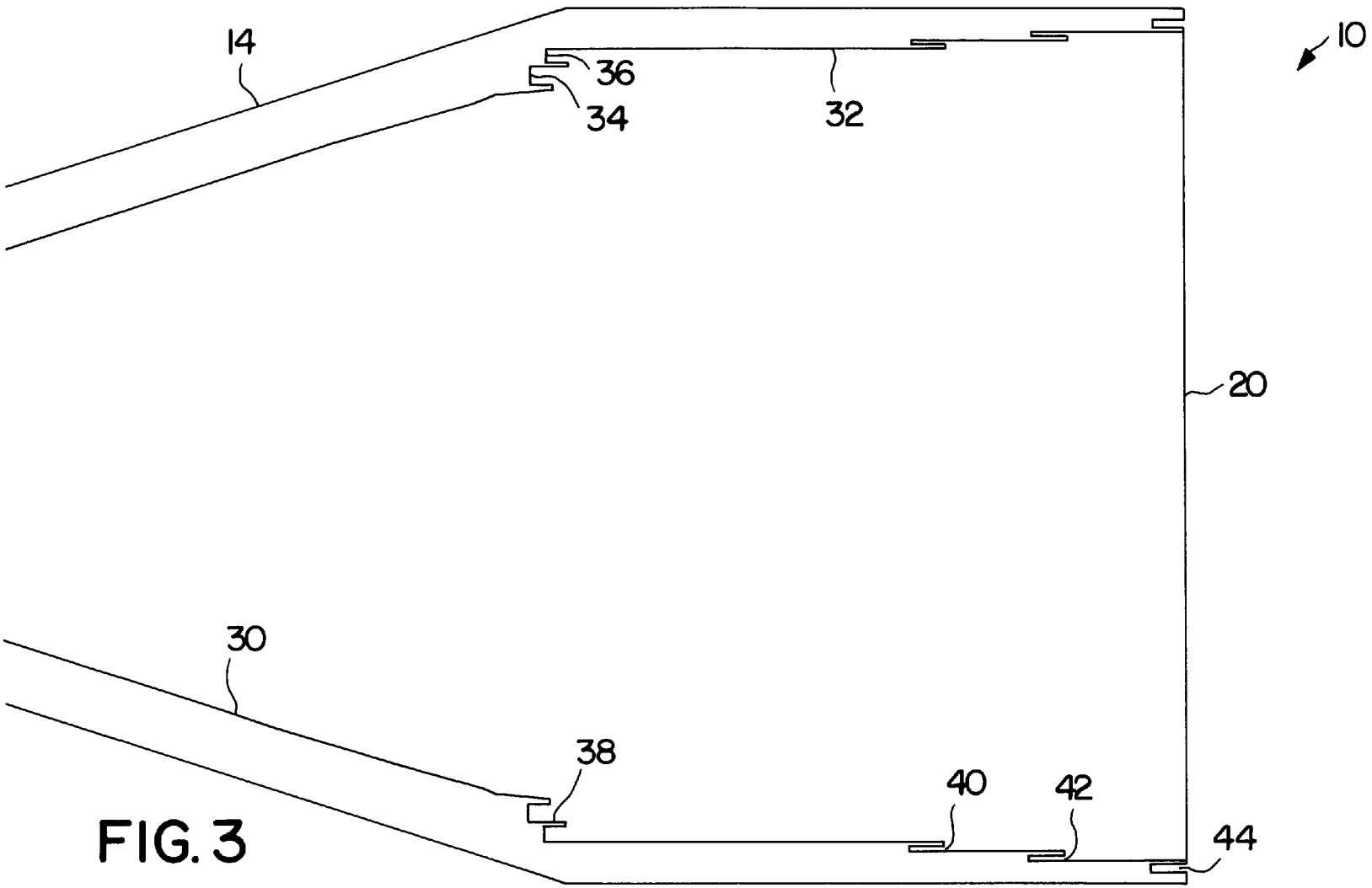
FIG. 3 is an enlarged side plan view of a choke section of the feed horn shown in FIGS. 1 and 2.

FIG. 3 is an enlarged side plan view of the aperture section 16. The outer surface of the aperture section 16 is cylindrical in shape. An aperture inner surface 32 of the aperture section 16 is generally cylindrical in shape, and includes a series of strategically configured and positioned chokes, according to the invention. Particularly, a first choke 34 and a second choke 36 are formed at the transition location between the inner profile surface 30 and the inner aperture surface 32. Both of the chokes 34 and 36 are annular notches formed in the inner surface 32 of the horn 10 that have radial and axial dimensions selected by a horn optimization process depending on the frequency and bandwidth of the signal desired. As is apparent, the chokes 34 and 36 are adjacent to each other and separated by a common wall 38, where the annular choke 36 has a larger diameter and is outside of the annular choke 34. The discontinuity in the inner surface of the horn 10 provided by the chokes 34 and 36 causes higher propagating modes to be generated for increased signal bandwidth.

The inner surface 32 of the aperture section 16 also includes chokes 40, 42 and 44 proximate the mouth 20 of the aperture section 16. The choke 44 is formed in the end of the horn 10 at the mouth 20, and the chokes 40 and 42 are formed in the surface 32, as shown. Each of the chokes 40, 42 and 44 are also annular notches having radial and axial dimensions, where the diameter of the choke increases from the choke 40 to the choke 44, as shown. The chokes 40, 42 and 44 are spaced apart from each other a predetermined amount, as shown, and have a narrower radial dimension than the chokes 34 and 36. The chokes 40, 42 and 44 act to absorb surface currents in the aperture section 16 proximate the mouth 20 to help equalize the E-plane and H-plane beamwidths, suppress the sidelobes and lower the cross-polarization. The chokes 34, 36, 40, 42 and 44 combine to control the mode content at the mouth 20 to provide an output signal that has low cross-polarization, low sidelobes, is circularly polarized and has a 10% or more operational bandwidth.

The internal diameter of the throat section 12 relative to the wavelength $\lambda$ of the signal being transmitted only allows propagation of the lower $TE_{11}$ mode. Propagation of the $TE_{11}$ modes limits the E-plane beamwidth, and thus does not allow propagation of substantially equal E-plane and H-plane beamwidths necessary for circular polarization. This creates a large axial ratio causing the signal to be elliptically polarized, as discussed above, reducing signal strength and increasing data rate loss. In order for the E-plane beamwidth to match the H-plane beamwidth by allowing the transmission of higher propagation modes, such as the $TM_{11}$ mode, a discontinuity must be provided within the horn 10 that expands the propagation diameter of the horn 10. A discussion of the transmission of the TE and TM modes in a feed horn of this type, including providing equal E-plane and H-plane beamwidths, can be found in the Potter article referenced above. The chokes 34, 36, 40, 42 and 44 provide this discontinuity. The combination of the chokes 34, 36, 40, 42 and 44 allows the designer of the horn 10 to optimize the weighting of higher order modes by providing the necessary phase and amplitude relationships between these higher modes for increased bandwidth.

The chokes 34, 36, 40, 42 and 44 give the flexibility to provide phase and amplitude matching for the propagating modes over a wider bandwidth, on the order of 10%–20%, at the mouth 20. The location of the chokes 34, 36, 40, 42 and 44, as well as the radial and axial dimensions of the chokes 34, 36, 40, 42 and 44, is experimentally optimized to provide the desirable phase and amplitude matching of the mode content at the horn aperture for this purpose. This control of the mode content provides for minimizing the length of the feed horn 10, maximizing the size of the mouth 20 at the desired operational bandwidth, and provide radiation patterns with equal E- and H-plane beamdwidths, suppressed sidelobes and low-cross polarization. Additional chokes may also be provided within the horn 10 to further optimize the signal propagation consistent with the discussion above.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A feed horn for transmitting a signal, said signal having both E-plane and H-plane beamwidths, said horn comprising:

a throat section configured to accept the signal;

a profile section connected to the throat section; and an aperture section connected to the profile section and defining an aperture of the horn, said aperture section including a plurality of chokes that are formed in an internal wall of the aperture section, said plurality of chokes including at least one choke positioned at a transition location between the profile section and the aperture section, at least one choke positioned at the aperture and a plurality of chokes positioned between the transition location and the aperture, said plurality of chokes altering the mode content of the signal to create substantially equal E-plane and H-plane beamwidths with suppressed sidelobes.

2. The feed horn according to claim 1 wherein the plurality of chokes are annular notches formed in the internal wall of the aperture section.

3. The feed horn according to claim 1 wherein the plurality of chokes includes a first choke and a second choke positioned at the transition location between the profile section and the aperture section, said first and second chokes including a common wall therebetween.

4. The feed horn according to claim 1 wherein the plurality of chokes is five chokes, including two chokes positioned at the transition location between the profile section and the aperture section, another choke formed in the aperture, and two other chokes formed at intermediate locations between the aperture and the transition location between the profile section and the aperture section.

5. The feed horn according to claim 1 wherein the throat section includes an outer surface that is generally cylindrical and an inner surface that includes a cylindrical portion and at least one expanding portion that expands the inside of the throat section.

6. The feed horn according to claim 5 wherein the at least one expanding portion is a first expanding portion having one expanding shape and a second expanding portion having a different expanding shape.

7. The feed horn according to claim 1 wherein the throat section has a general cylindrical shaped outer surface, the profile section has a general conical shaped outer surface, and the aperture section has a general cylindrical shaped outer surface.

8. A feed horn for transmitting a signal, propagating in both E-plane and H-plane beamwidths, said horn comprising:

a throat section configured to accept the signal, said throat section including an inner surface having a cylindrical portion and at least one expanding portion that expands the inside of the throat section;

a profile section connected to the throat section; and an aperture section connected to the profile section and defining an aperture of the horn, said aperture section including a plurality of chokes that are annular notches formed in an internal wall of the aperture section, said plurality of chokes including a first choke and a second choke positioned at a transition location between the profile section and the aperture section and including a common wall therebetween, a third choke formed in the aperture and a plurality of additional chokes positioned between the profile section and the aperture, said plurality of chokes altering the mode content of the signal at the aperture to create substantially equal E-plane and H-plane beamwidths with suppressed sidelobes across a relatively wide bandwidth.

9. The feed horn according to claim 8 wherein the plurality of other chokes is two other chokes making a total of five chokes notched in the internal surface of the aperture section.

10. The feed horn according to claim 8 wherein the at least one expanding portion is a first expanding portion having one expanding shape and a second expanding portion having a different expanding shape.

11. The feed horn according to claim 8 wherein the throat section has a general cylindrical shaped outer surface, the profile section has a general conical shaped outer surface, and the aperture section has a general cylindrical shaped outer surface.

12. The feed horn according to claim 8 wherein the feed horn is part of an antenna system including a feed array on a satellite, said signal being a satellite downlink signal, said feed array including a plurality of identical feed horns.

13. The feed horn according to claim 12 wherein the feed array is selected from the group consisting off front-fed feed arrays, side-fed feed arrays, Gregorian feed arrays, and cassegrain feed arrays.

14. A feed horn for transmitting a signal, said signal having both E-plane and H-plane beamwidths, said horn comprising:

a throat section configured to accept the signal, wherein the throat section includes an outer surface that is generally cylindrical and an inner surface that includes a cylindrical portion, a first expanding portion having one shape and a second expanding portion having a different shape than the first expanding portion;

a profile section connected to the throat section, wherein the first and second expanding portions continually increase the inside size of the throat section towards the profile section; and an aperture section connected to the profile section and defining an aperture of the horn, said aperture section including a plurality of chokes that are formed in an internal wall of the aperture section, said plurality of chokes altering the mode content of the signal to create substantially equal E-plane and H-plane beamwidths with suppressed sidelobes.

15. The feed horn according to claim 14 wherein the plurality of chokes are annular notches formed in the internal wall of the aperture section.

16. The feed horn according to claim 14 wherein the plurality of chokes include a first choke and a second choke positioned at a transition location between the profile section and the aperture section, said first and second chokes including a common wall therebetween.

17. The feed horn according to claim 14 wherein the plurality of chokes includes a choke formed in the aperture and a plurality of chokes positioned between the profile section and the aperture.

18. A method of forming a feed horn, said method comprising the steps of:

providing a throat section;

providing a profile section connected to the throat section; and providing an aperture section connected to the profile section so that the aperture section includes an aperture of the horn and a plurality of chokes formed in an internal wall of the aperture section, said plurality of chokes including at least one choke positioned at a transition location between the profile section and the aperture section, at least one choke positioned at the aperture and a plurality of chokes positioned between the transition location and the aperture, said plurality of chokes being formed to alter the mode content of the signal to create substantially equal E-plane and H-plane beamwidths with suppressed sidelobes.

19. The method according to claim 18 wherein the step of providing an aperture section includes forming the plurality of chokes as annular notches in the internal wall.

20. The method according to claim 19 wherein the step of forming the plurality of chokes includes forming a first choke and a second choke at the transition location between the profile section and the aperture section where the first and second chokes share a common wall.

21. The method according to claim 18 wherein the step of providing a throat section includes providing a throat section with a generally cylindrical inner surface portion and a plurality of expanding portions.

* * * * *